United States Patent [19]

Sarvanne

[11] 4,324,531

[45] Apr. 13, 1982

[54] GUIDE APPARATUS FOR A SUBMERSIBLE PUMP

[75] Inventor: Hannu Sarvanne, Vantaa, Finland

[73] Assignee: Oy E. Sarlin AB, Kaivoksela, Finland

[21] Appl. No.: 108,404

[22] Filed: Dec. 28, 1979

Related U.S. Application Data

[63] Continuation of Ser. No. 915,073, Jun. 12, 1978, abandoned.

[51] Int. Cl.[3] ..... F04B 39/14

[52] U.S. Cl. ..... 417/360

[58] Field of Search ..... 417/360, 361

[56] References Cited

U.S. PATENT DOCUMENTS 3,427,982 2/1969 Englesson ..... 417/360 UX 3,880,553 4/1975 Wolford et al. ..... 417/360

*Primary Examiner*—Richard E. Gluck

*Attorney, Agent, or Firm*—Martin Smolowitz

[57] ABSTRACT

Pump means comprising a pump and a motor, combined to constitute a pump unit for submersion in a liquid, and a pump delivery pipe and a vertical guide track both fixedly mounted in a liquid container, such as a sewage weill for instance, the latter guiding the pump unit and enabling it to be lowered into the liquid tank so that the delivery port of the pump will connect with the delivery pipe, and the pump unit having been fitted with a bipartite slide carried on the guide track. The guide track comprises two guides and that the slide comprises two lower projections and two upper projections, and that the slide has been so connected to the delivery aperture of the pump that the lower projections are located below and the upper projections above the delivery port.

1 Claim, 3 Drawing Figures

GUIDE APPARATUS FOR A SUBMERSIBLE PUMP

Figure 1:
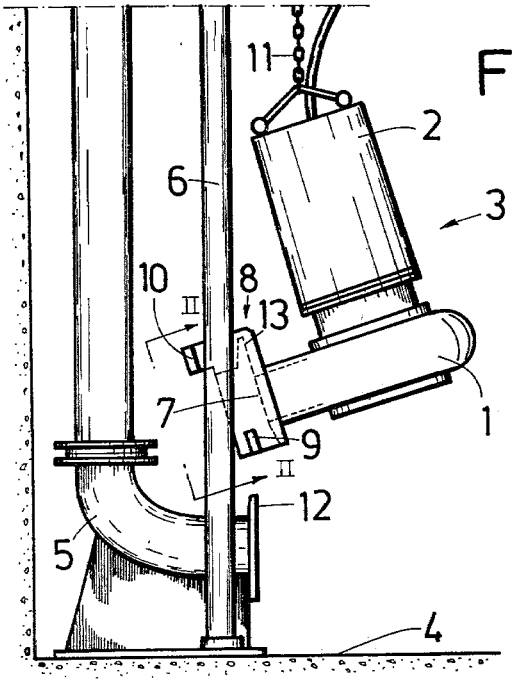

This is a continuation of application Ser. No. 915,073 filed June 12, 1978, now abandoned.

BACKGROUND OF INVENTION

In pump means of prior art, the guide usually has the shape of a rod or rail and the slide moving thereon constitutes a sleeve or a sleeve-like member encircling the guide. A slide of this type is satisfactory as long as the guide is new and clean, but its operation is decisively impaired when there are impurities on the surface of the guide. Since submergible pumps are expressly most often used in sewage wells, it is clearly obvious that the guides in the dirty accumulate rust on their surface, whereby slides of prior art tend to bind on the guides when the pump is being lifted or lowered.

SUMMARY OF INVENTION

The object of the present invention is to eliminate the drawback pointed out by the means that the guide track comprises two guides and that the slide presents two lower projections and two upper projections, and that the slide has been so attached to the delivery port of the pump that the lower projections are located below and the upper projections above the delivery port. The slide has no sleeve or clamp encircling the guide. The parts of the slide merely rest against the guide on one side thereof. This, again, permits the pump unit to be freely tilted during lifting, without causing any wedging effect between the slide and the guide. Two guides are advantageous for the reason that hereby the movements of the pump unit in lateral direction can be exactly controlled so that the delivery port of the pump will properly register with the delivery pipe. Since the slide is located quite close to the delivery port of the pump, it is obvious that the delivery port can be better guided into register with the delivery pipe.

The invention is described in the following by the aid of an example and with reference to the attached drawing, wherein In the drawings:

FIG. 1 presents in elevational view and in section, a sewage well wherein a pump means of the invention has been installed.

Figure 2:
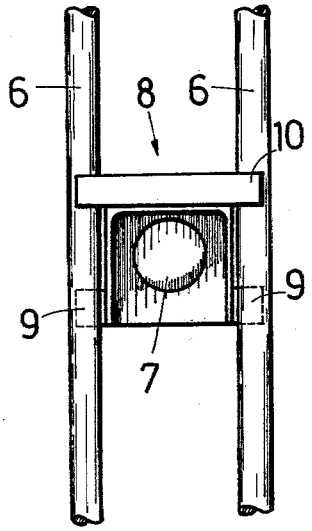

FIG. 2 shows the section carried along the line II—II in FIG. 1.

Figure 3:
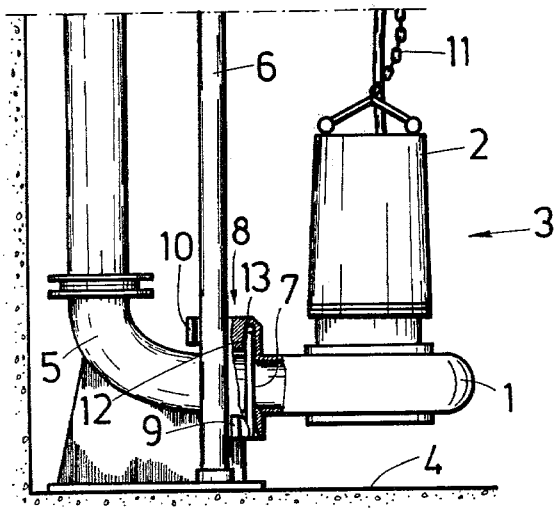

FIG. 3 corresponds to FIG. 1 and depicts a pump means of which the pump unit has been lowered down.

DESCRIPTION OF INVENTION

FIG. 1 shows a sewage well 4, on the bottom of which the pump delivery pipe 5 and the vertical guide 6 have been mounted. Furthermore, the figure reveals the pump unit 3, comprising the combined pump 1 and its motor 2. The pump unit has been suspended by the chain 11 and its position when hanging freely is somewhat tilted, owing to the shape of the pump 1. To the delivery port 7 of the pump the slide 8 has been attached, comprising a lower projection 9 and an upper projection 10. Due to the tilted position of the pump unit 3, the projections of the slide 9 and 10 are distanced from the guide 6 and permit unobstructed movement of the slide, regardless of any impurities which may be lodged on the guide 6. The projections 9 and 10 afford sufficient guidance so that the flange 12 of the delivery pipe 5 will enter the recess 13 of the slide 8. The figure does not show the water in the sewage well 4, nor any impurities on the guide 6, in the interest of clarity.

FIG. 2 reveals the design of the slide 8, as seen from the direction of the pump's delivery port 7. The slide comprises two lower projections 9 and two upper projections 10, between which the guides 6 remain. The projections 9 and 10 of the slide are spaced with reference to each other and located at different heights so that as the pump unit is tilted the projections of the slide move away from the guides, permitting free vertical motion regardless of impurities lodged on the guides.

FIG. 3 shows the pump means readied for operation, the pump unit 3 being lowered. It is seen from this figure that when during the lowering of the pump unit the flange 12 of the delivery pipe 5 contacts the respective recess 13 of the slide, this gives rise to a point of support, whereby the pump unit 3 that is being lowered is turned into vertical position. The delivery port 7 of the pump 1 will then register immediately with the delivery pipe 5 and it will be tightly pressed against the flange 12. The pump unit is now ready for operation. It is also seen from the figures that the projections of the slide 8 according to the invention constitute, as the pump unit 3 is being lowered, a loose though sufficiently accurate guidance for guiding the flange 12 of the delivery pipe 5 into the recess 13 of the slide 8.

It is obvious to a person skilled in the art that various embodiments of the invention may vary within the scope of the claims following below.

I claim:

1. An improved apparatus employing a pump and a motor, these being combined to form a pump unit for submersion in a liquid, said unit being integrally mounted in a liquid tank, a pump delivery pipe and a vertical guide track, the latter guiding the pump unit and enabling it to be lowered into the liquid tank whereby said pump is provided with a delivery port which is connected with the delivery pipe, said pump unit being connected to a bipartite slide resting against the guide track, said slide having a recess therein for receiving a flange formed of said delivery pipe, wherein the improvement comprises, providing the guide track with two guides and said slide is defined by two lower projections and two upper projections between which said guides are disposed, said lower projection being positioned on the same side of said guides as said delivery port and said upper projection being positioned on the opposite side of said guides, whereby, uninhibited vertical travel of said pump with respect to said slide and guides is possible by tilting of said pump unit during lifting or lowering, and said slide being connected to the delivery port of the pump, whereby the lower projections are located below and the upper projections above the delivery port; and said projections during lowering of said pump unit guide said flange of said delivery pipe into said recess of said slide to urge registration between said delivery port and said delivery pipe.

* * * * *